US007389982B2

(12) United States Patent
Makino et al.

(10) Patent No.: US 7,389,982 B2
(45) Date of Patent: Jun. 24, 2008

(54) IMAGE FORMING DEVICE CAPABLE OF FEEDING PAPER SMOOTHLY

(75) Inventors: Kazumasa Makino, Shenzhen (CN); Masahiro Kamimura, Nagoya (JP); Yoshiyuki Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 293 days.

(21) Appl. No.: 10/893,496

(22) Filed: Jul. 19, 2004

(65) Prior Publication Data

US 2005/0051944 A1 Mar. 10, 2005

(30) Foreign Application Priority Data

Jul. 22, 2003 (JP) ..... P2003-277485

(51) Int. Cl.
*B65H 3/06* (2006.01)

(52) U.S. Cl. ..... 271/153; 271/152; 271/127

(58) Field of Classification Search ..... 271/126, 271/127, 152, 153, 121
See application file for complete search history.

(56) References Cited

U.S. PATENT DOCUMENTS 5,228,676 A * 7/1993 Arai et al. ..... 271/117
5,294,106 A 3/1994 Takagi et al.
5,678,814 A * 10/1997 Yokoyama et al. ..... 271/9.05
5,823,524 A * 10/1998 Kawada ..... 271/124
6,422,773 B1 * 7/2002 Lim ..... 400/710
6,994,341 B2 * 2/2006 Aoki et al. ..... 271/117

FOREIGN PATENT DOCUMENTS

| | | |
|---|---|---|
| JP | A-3-288736 | 12/1991 |
| JP | A-5-69983 | 3/1993 |
| JP | A-6-72572 | 3/1994 |
| JP | A 9-278196 | 10/1997 |
| JP | A-11-11709 | 1/1999 |
| JP | A-2000-95360 | 4/2000 |
| JP | A-2002-104666 | 4/2002 |

* cited by examiner

*Primary Examiner*—Kaitlin S Joerger
(74) *Attorney, Agent, or Firm*—Oliff & Berridge, PLC

(57) ABSTRACT

An image-forming device includes an image-forming section, a separating/feeding section that separates and feeds sheets of paper from a stack into the image-forming section one sheet at a time, a pressing plate disposed on the opposite side of the stacked paper from the separating/feeding section, and a drive section that drives the pressing plate. The drive section drives the pressing plate toward the separating/feeding section when the separating/feeding section is in contact with the paper and driving of the separating/feeding section has stopped.

20 Claims, 8 Drawing Sheets

IMAGE FORMING DEVICE CAPABLE OF FEEDING PAPER SMOOTHLY

BACKGROUND OF THE INVENTION

1. Field of the Invention

The present invention relates to an image-forming device capable of feeding paper smoothly.

2. Related Art

One conventional construction for a paper supply section used in a printer or other image-forming device is disclosed in Japanese unexamined patent application publication No. HEI-9-278196. The paper supply section of this image-forming device includes a pickup roller for feeding the topmost sheet of paper stacked on a stacking plate, a conveying roller disposed downstream of the pickup roller, and a reverse roller disposed in contact with the conveying roller. The reverse roller is also referred to as a retard roller.

The pickup roller, the conveying roller, and the reverse roller together constitute a separating/feeding section for separating and feeding the stacked sheets of paper one sheet at a time. The paper supply section further includes a lifter for urging the stacking plate toward the separating/feeding section.

The lifter is driven at a timing in which the pickup roller is withdrawn above the sheets of paper. In other words, the stacking plate is raised during a time that paper is not being fed. As a result, this construction can stably feed paper without variations in the amount of frictional force that the pickup roller applies to the paper.

With the image-forming device described above, there has been demand for increasing the paper feeding speed and reducing the gap between fed sheets of paper in order to shorten the printing time when printing a plurality of sheets of paper one sheet after another (multiple page printing).

Hence, the time during which paper is not being fed has become increasingly shorter in recent years. Accordingly, when constructing a paper supply section as described above, it is no longer possible to secure sufficient time when paper is not being fed in order to drive the lifter to raise the paper stacking plate when the amount of stacked paper has decreased, leading to problems in paper feeding.

SUMMARY OF THE INVENTION

In the view of foregoing, it is an object of the present invention to overcome the above problems, and also to provide an image-forming device capable of securing sufficient time for driving the paper stacking plate to ensure reliable paper feeding, even when the paper feeding speed is increased.

In order to attain the above and other objects, according to one aspect of the present invention, there is provided an image-forming device including an image forming unit that forms images on a recording medium, a plate that mounts a stack of recording medium, a separating/feeding unit that separates a recording medium from the stack and feeds the recording medium in a conveying direction, a drive unit that moves the plate toward the separating/feeding unit, and a controller that controls the drive unit to start moving the plate toward the separating/feeding unit. The controller controls the drive unit to start moving the plate toward the separating/feeding unit when the separating/feeding unit is in contact with the stack of recording medium and driving of the separating/feeding unit has stopped.

According to another aspect of the present invention, there is provided an image-forming device including an image forming unit that forms images on a recording medium, a plate that mounts a stack of recording medium, a separating/feeding unit that separates a recording medium from the stack and feeds the recording medium in a conveying direction, a drive unit that moves the plate toward the separating/feeding unit, a conveying roller disposed downstream of the separating/feeding unit with respect to the conveying direction, and a controller that controls the drive unit to move the plate toward the separating/feeding unit. The controller controls the drive unit to start moving the plate when both the separating/feeding unit and the conveying roller are in contact with the same recording medium.

PREFERRED EMBODIMENTS OF THE PRESENT INVENTION

Next, a laser printer according to an embodiment of the present invention will be described with reference to the accompanying drawings.

Figure 1:
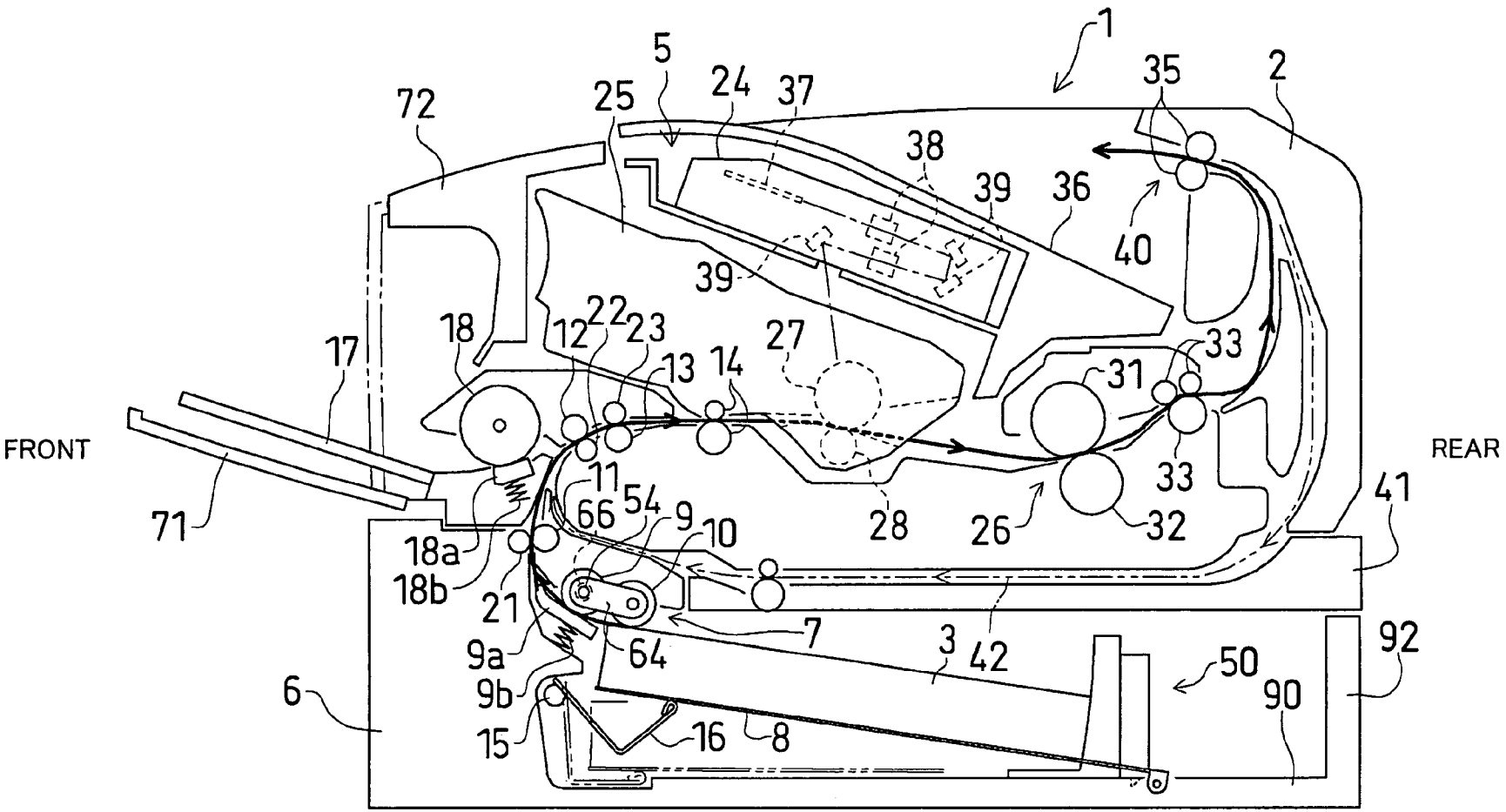
FIG. 1 is a side cross-sectional view showing the general construction of a laser printer according to an embodiment of the present invention.

The laser printer 1 shown in FIG. 1 is an electrophotographic type printer capable of performing duplex printing. As shown in FIG. 1, the laser printer 1 includes a separating/feeding section 7 for feeding sheets of a paper 3, and an image-forming section 5 for forming prescribed images on the paper 3 supplied from the separating/feeding section 7.

In the following description, upstream or downstream in a sheet feed direction in which the paper 3 is conveyed will be abbreviated as simply "upstream" or "downstream". Also, the expression "front", "rear", "left", "right", "upper", "below" are used throughout the description to define the various parts when the printer 1 is disposed in an orientation in which it is intended to be used.

As shown in FIG. 1, the laser printer 1 includes a main casing 2. A paper cassette 6 having an open-top box shape is mounted in a bottom section of the main casing 2. The separating/feeding section 7 is disposed in one end of the paper cassette 6 near the front of the main casing 2.

A paper pressing plate 8 is disposed inside the paper cassette 6. The paper pressing plate 8 is capable of mounting a stack of paper 3 thereon and disposed in opposition to the separating/feeding section 7 via the stack of paper 3.

As is described later, the paper cassette 6 is slidably supported in the main casing 2. To load paper, the paper cassette 6 is pulled out through the front of the main casing 2, exposing an area including the paper pressing plate 8. After loading paper 3 on the paper pressing plate 8, the paper cassette 6 is slid back into the main casing 2 by pushing the paper cassette 6 toward the rear of the main casing 2. Further, the paper cassette 6 can be completely removed from the main casing 2 when pulling the paper cassette 6 out through the front.

Provided downstream of the separating/feeding section 7 are a first conveying roller 11, a second conveying roller 12, and a third conveying roller 13 in order from upstream to downstream. A pair of registration rollers 14 is disposed downstream of the third conveying roller 13.

Paper dust collecting rollers 21, 22, and 23 are disposed in confrontation with the first through third conveying rollers 11-13, respectively. Each of the paper dust collecting rollers 21, 22, and 23 includes a roller having a surface conducive to electrical charging, such as a roller formed of a fluorocarbon resin or a roller having a surface coated with fluorine, for example. The paper dust collecting rollers 21, 22, and 23 electrostatically attract and remove paper dust deposited on the paper 3 to prevent the paper dust from mixing with toner in the image-forming section 5 described later, which can lead to a deterioration in printing quality.

The separating/feeding section 7 includes a pickup roller 10, a feeding roller 9 disposed downstream of the pickup roller 10, and a separating pad 9*a* confronting the feeding roller 9. The pickup roller 10 and the feeding roller 9 are disposed on the main casing 2 side, while the separating pad 9*a* is provided on the paper cassette 6 side. An urging spring 9*b* is provided on the separating pad 9*a*. The elastic force of the urging spring 9*b* presses the separating pad 9*a* against the feeding roller 9.

More specifically, the feeding roller 9 is integrally fixed to a drive shaft 54. The feeding roller 9 is driven to rotate by a driving force communicated to the drive shaft 54, as will be described later. One end of a support arm 64 is mounted on the drive shaft 54 so that the support arm 64 can swing about the axis of the drive shaft 54. The pickup roller 10 is rotatably supported on the free end of the support arm 64. The support arm 64 is urged in the clockwise direction of FIG. 1 by a spring (not shown) so that the pickup roller 10 is urged toward the paper 3.

The pickup roller 10 conveys the uppermost sheet of the paper 3 toward the feeding roller 9 so that the paper 3 becomes interposed between the separating pad 9*a* and the feeding roller 9. Through the cooperative operations of the separating pad 9*a* and the feeding roller 9, the paper 3 is separated and fed one sheet at a time.

As described above, the separating/feeding section 7 includes not a single roller, but the pickup roller 10 and the feeding roller 9 that are juxtaposed substantially on the horizontal. Since these rollers 10 and 9 can have a smaller diameter than that of a single roller used for picking up and separating the paper 3, the amount of vertical space in particular for mounting the separating/feeding section 7 in the laser printer 1 can be more compact, resulting in a more compact laser printer 1.

Further, the separating/feeding section 7 employs a separating pad system with the urging spring 9*b* for pressing the separating pad 9*a* against the feeding roller 9. The construction of this system can be simpler than that of a retard roller system (a system having a retard roller in place of the separating pad 9*a* that is driven to rotate in a direction opposite that of the feeding roller 9 for separating the paper 3) because the construction needed to drive the retard roller can be eliminated.

The sheet pressing plate 8 is capable of supporting a stack of paper 3. The sheet pressing plate 8 is pivotably supported at its end furthest from the feeding roller 9 (rear end) so that the end of the sheet pressing plate 8 that is nearest the feeding roller 9 can move upward and downward.

A rotational shaft 15 is supported in the paper cassette 6 below the feeding roller 9. An L-shaped pressing member 16 is affixed to the rotational shaft 15 such that the free end of the pressing member 16 is inserted below the paper pressing plate 8. The rotational shaft 15 can be driven by a pressing plate drive unit 68 (FIGS. 2 and 3) described later, which includes an electric motor and a gear train. By driving the rotational shaft 15 with the pressing plate drive unit 68, the pressing member 16 is pushed upward against the bottom surface of the paper pressing plate 8, causing the paper pressing plate 8 to pivot upward about the rear end, which is the end farthest from the separating/feeding section 7. As a result, the paper pressing plate 8 moves in a direction toward the separating/feeding section 7.

When the paper pressing plate 8 is driven (moved) upward by the pressing plate drive unit 68, the paper 3 stacked on the paper pressing plate 8 is pushed against the pickup roller 10.

A drop-detecting sensor 66 is provided on the support arm 64, which supports the pickup roller 10. The drop-detecting sensor 66 detects a decline in the amount of the paper 3 stacked on the paper pressing plate 8 by sensing the position of the topmost sheet of the paper 3 on the paper pressing plate 8. In other words, when the amount of paper 3 stacked on the paper pressing plate 8 declines as the separating/feeding section 7 is driven to feed the paper 3 one sheet at a time, the pickup roller 10 contacting the top of the topmost sheet of paper 3 gradually lowers through the downward urging effect of the spring (not shown) mounted in the support arm 64. The drop-detecting sensor 66 turns ON after detecting that the pickup roller 10 has fallen below a prescribed height (that is, when the position of the topmost sheet of the paper 3 reaches a prescribed position).

A controller 100 described later (FIG. 7) determines that the amount of paper 3 stacked on the paper pressing plate 8 has declined when the drop-detecting sensor 66 turns ON, and then the controller 100 drives the pressing plate drive unit 68 at a prescribed timing to raise the paper pressing plate 8 (described in greater detail later). Through this operation, the paper 3 can be pressed against the pickup roller 10 with sufficient pressure regardless of the amount of paper 3 stacked on the paper pressing plate 8, enabling the pickup roller 10 to pick up the paper reliably. The drop-detecting sensor 66 may be an optical sensor, a limit switch, or the like.

The paper 3 fed by the separating/feeding section 7 is received and conveyed in succession by the first through third conveying rollers 11-13 and supplied to the registration rollers 14. The pair of registration rollers 14 performs a desired registration operation on the supplied paper 3 and transports the same to the image forming section 5.

A multipurpose tray 17 is disposed on the front of the laser printer 1. The multipurpose tray 17 can be opened and closed, and paper 3 of a desired size can be stacked on the multipurpose tray 17 in the open position. A multipurpose feeding roller 18 is disposed near the multipurpose tray 17 for feeding the paper 3 from the stack on top of the multipurpose tray 17. A multipurpose separating pad 18*a* is provided in confrontation with the multipurpose feeding roller 18. A spring 18*b* presses the multipurpose separating pad 18*a* against the multipurpose feeding roller 18.

A first cover 71 is swingably mounted on the front surface of the laser printer 1. Placing the multipurpose tray 17 and the first cover 71 in a closed position when not using the multipurpose tray 17 provides a neat appearance to the front surface of the laser printer 1 and protects the multipurpose feeding roller 18, the multipurpose separating pad 18*a*, and other internal components.

With this construction, paper (not shown) loaded on the multipurpose tray 17 becomes interposed between the multipurpose feeding roller 18 and the multipurpose separating pad 18*a* and is separated and supplied one sheet at a time through the cooperative operations of the multipurpose feeding roller 18 and the multipurpose separating pad 18*a*. Paper fed from the multipurpose tray 17 is conveyed to the registration rollers 14 by the second and third conveying rollers 12 and 13.

The image forming section 5 includes a scanner section 24, a process cartridge 25, and a fixing section 26. The scanner section 24 is provided in the upper section of the main casing 2 and is provided with a laser emitting section (not shown), a rotatingly driven polygon mirror 37, lenses 38, and reflection mirrors 39. The laser emitting section emits a laser beam based on desired image data. As indicated by dot chain line in FIG. 1, the laser beam passes through or is reflected so as to irradiate, in a high speed scanning operation, the surface of a photosensitive drum 27 of the process cartridge 25.

The process cartridge 25 is detachably mounted in the main casing 2 at a position below the scanner section 24. The process cartridge 25 includes the photosensitive drum 27 and a transfer roller 28 disposed in confrontation with the photosensitive drum 27. Although not shown in the drawings, the process cartridge 25 further includes a scorotron charger, a toner hopper, a developing roller, a thickness-regulation blade, and a toner-supply roller. A second cover 72 is disposed at the front on the upper surface of the main casing 2 so as to be freely pivotable. The process cartridge 25 can be mounted in and removed from the main casing 2 by opening the second cover 72.

The toner hopper is filled with positively charging, non-magnetic, single-component toner as a developer. The toner is carried on the developing roller as a thin layer of toner having a uniform thickness on the developing roller.

The photosensitive drum 27 shown in FIG. 1 is rotatably supported in confrontation with the developing roller. The photosensitive drum 27 is formed of a main drum that is grounded. The surface of the main drum is a positively-charging photosensitive layer formed of polycarbonate or the like.

As the photosensitive drum 27 rotates, the scorotron charger forms a uniform positive charge over the surface of the rotating photosensitive drum 27. Subsequently, a laser light emitted from the scanner section 24 scans across the surface of the photosensitive drum 27 at a high speed, so that electrostatic latent images are formed on the surface of the photosensitive drum 27 in accordance with image data. Then, the positively charged toner carried on the surface of the developing roller is brought into contact with the photosensitive drum 27. At this time, the toner is selectively attracted to portions of the photosensitive drum 27 that were exposed to the laser beam and, therefore, have a lower potential than the rest of the surface having a uniform positive charge, thereby transforming the latent images formed on the surface of the photosensitive drum 27 into toner images. In this way, reversal development is achieved.

The transfer roller 28 is rotatably supported in the process cartridge 25 at a position below and in confrontation with the photosensitive drum 27.

The toner image carried on the surface of the photosensitive drum 27 is transferred to the paper 3 as the paper 3 passes between the photosensitive drum 27 and the transfer roller 28. The paper 3 formed with the toner image in this manner is conveyed to the fixing section 26 by a conveying belt and the like (not shown).

The fixing section 26 includes a heat roller disposed downstream of the process cartridge 25, a pressure roller 32 disposed in confrontation with the heat roller 31, and convey rollers 33 disposed downstream of the heat roller 31 and the pressure roller 32.

The heat roller 31 is made of metal and houses a halogen lamp for generating heat. With this configuration, toner transferred onto the paper 3 at the process cartridge 25 is thermally fixed onto the paper 3 as the paper 3 passes between the heat roller 31 and the pressure roller 32. Afterwards, the convey rollers 33 convey the paper 3 to discharge rollers 35 disposed on the main casing 2. The discharge rollers 35 convey and discharge the paper 3 onto a discharge tray 36 provided on the upper surface of the main casing 2 through an discharge port 40.

A reconveying unit (auxiliary slide unit) 41 for forming images on both sides of the paper 3 is detachably mounted on the main casing 2 through insertion above the paper cassette 6. A reconveying path 42 is formed in the reconveying unit 41 and in the upper rear section of the main casing 2 for reconveying the paper 3 to the image-forming section 5 when performing duplex printing.

In a duplex printing process performed in the laser printer 1 having the construction described above, the paper 3 initially passes through the image-forming section 5, wherein an image is formed on one side of the paper 3, and is conveyed to the discharge rollers 35. Subsequently, the paper 3 interposed between the discharge rollers 35 is reversed by the same and conveyed back to the image-forming section 5 via the reconveying path 42. In the image-forming section 5, an image is formed on the other side of the paper 3. The reconveying unit 41 can slide in and out of the rear section of the device to facilitate removing paper 3 that has become jammed in the reconveying path 42.

Figure 2:
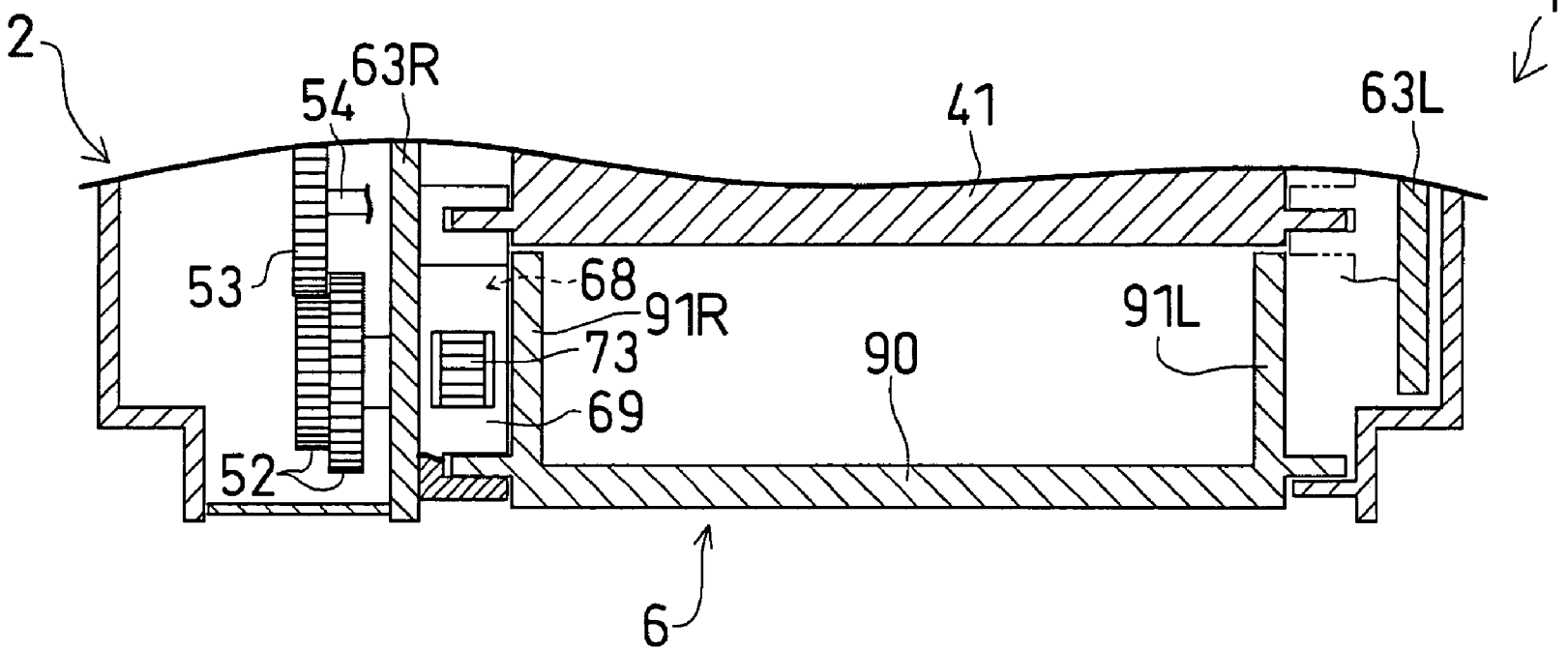
FIG. 2 is a front cross-sectional view showing the bottom section of the laser printer in FIG. 1.

As shown in FIG. 2, frames 63L and 63R formed of metal plates are provided on the left and right sides of the main casing 2. The paper cassette 6 is mounted inside the main casing 2 by slidingly inserting the paper cassette 6 between the frames 63L and 63R.

Figure 3:
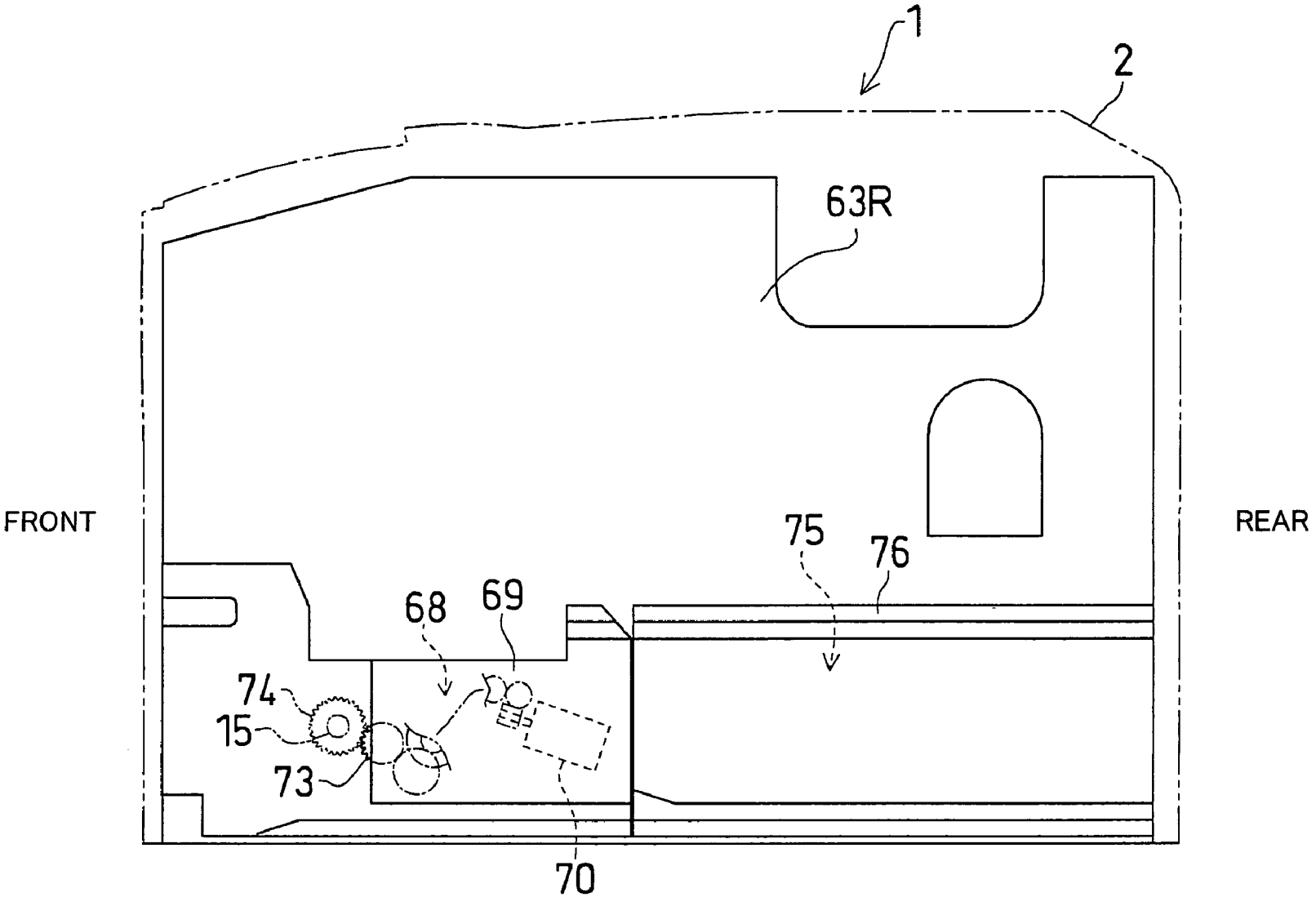
FIG. 3 is a cross-sectional view showing the construction of a pressing plate drive unit and a main motor unit.

As shown in FIGS. 2 and 3, the pressing plate drive unit 68 is mounted on the front inner surface of the frame 63R. The pressing plate drive unit 68 includes a drive motor 70, an output gear 73, and a gear train linking the drive motor 70 and the output gear 73 (only partially shown in FIG. 3).

The pressing plate drive unit 68 is covered by a drive unit cover 69 formed of a synthetic resin. The drive motor 70, the output gear 73, the gear train, and the like of the pressing plate drive unit 68 are either supported on or fixed to the drive unit cover 69. A portion of the output gear 73 is exposed through the front surface of the drive unit cover 69 in order to engage with an input gear 74 (described later) in the paper cassette 6.

As shown in FIG. 3, a main motor unit 75 is mounted on the rear inner surface of the frame 63R adjacent to the pressing plate drive unit 68. The main motor unit 75 includes a main motor, a gear train, and the like for driving all rollers in the separating/feeding section 7 and image-forming section 5 and along the paper conveying path (not shown in FIG. 3). The main motor unit 75 includes a motor unit cover 76 formed of a synthetic resin.

Figure 4:
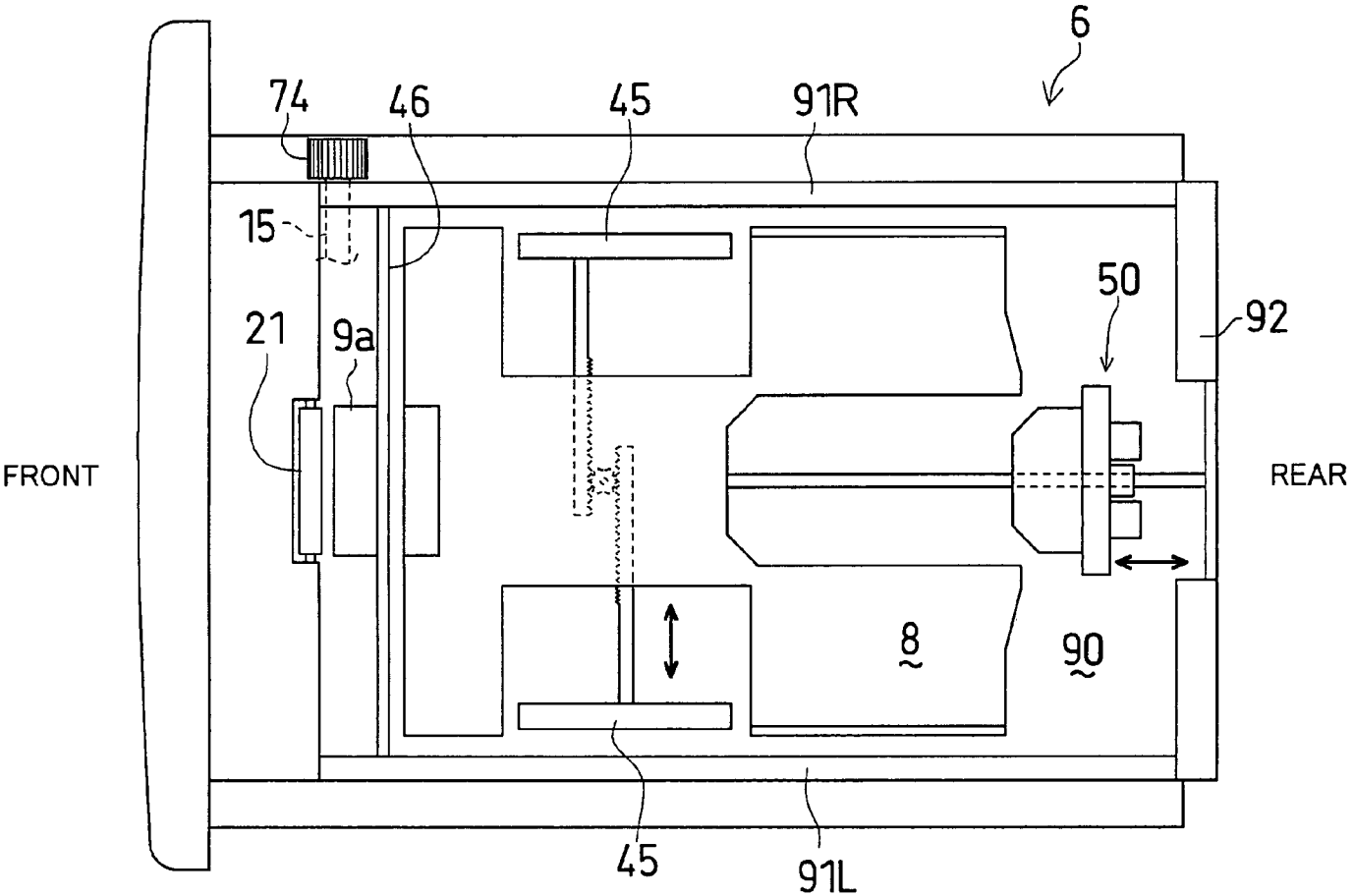
FIG. 4 is a plan view showing a paper cassette used in the laser printer.
Figure 5:
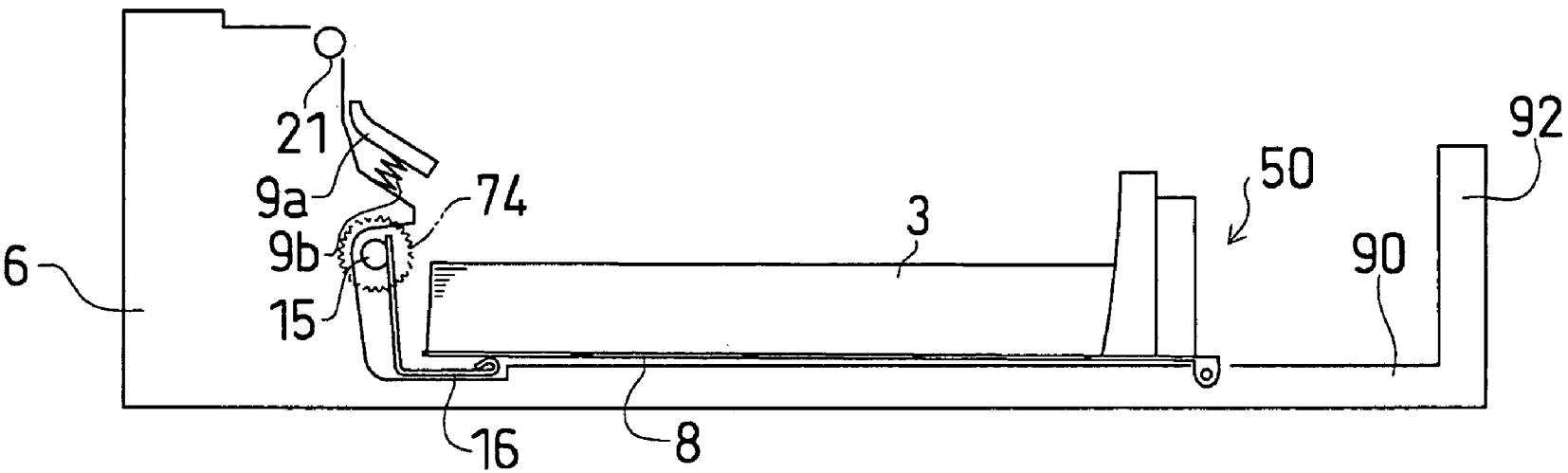
FIG. 5 is a side cross-sectional view showing the paper cassette of FIG. 4.

As shown in FIGS. 4 and 5, the paper pressing plate 8 is disposed above a bottom plate 90 of the paper cassette 6 and is capable of pivoting about a horizontal shaft. A left wall 91L and a right wall 91R are vertically erected from the left and right edges of the bottom plate 90, while a rear wall 92 is vertically erected from the rear edge of the bottom plate 90.

As shown in FIG. 4, the paper cassette 6 also includes side guides 45 for guiding the side edges of the paper 3 stacked on the paper pressing plate 8 and a rear guide 50 for guiding the rear edge of the paper 3. The positions of the side guides 45 and the rear guide 50 can be adjusted by moving the side guides 45 reciprocatingly in a lateral direction and the rear guide 50 in the front-to-rear direction in order to load various sizes of the paper 3. A reference wall 46 is provided on the front side of the paper pressing plate 8, and the leading edge of the paper 3 is always butted against the reference wall 46. Hence, the paper 3 can be stacked in a prescribed position on the paper pressing plate 8, with the leading edge contacting the reference wall 46, the rear edge contacting the rear guide 50, and the side edges contacting the side guides 45.

As shown in FIG. 4, the rotational shaft 15 penetrates the right wall 91R and protrudes from the right side. The input gear 74 is fixed to this protruding end. When the paper cassette 6 is inserted into the main casing 2, the input gear 74 engages with the output gear 73 exposed through the front surface of the drive unit cover 69 as shown in FIG. 3. When the drive motor 70 is driven in this state, the driving force of the drive motor 70 is transferred to the output gear 73 via the gear train, causing the output gear 73 to rotate. The input gear 74 engaged with the output gear 73 also rotates, causing the rotational shaft 15 to rotate. The rotation of the rotational shaft 15 pushes the pressing member 16 against the bottom surface of the paper pressing plate 8, raising the paper pressing plate 8 and pushing the paper 3 loaded on top of the paper pressing plate 8 against the pickup roller 10.

Next, the construction of a mechanism for driving the separating/feeding section 7 will be described with reference to FIG. 6. A drive gear 51 and a reduction sector gear 52 are rotatably supported on the outer surface of the frame 63R (the opposite side of the surface on which the pressing plate drive unit 68 is mounted).

The drive gear 51 is constantly rotated by a motive force communicated from the main motor unit 75 via a gear train (not shown). The rotational force of the drive gear 51 is communicated to other rollers (the first through third conveying rollers 11-13 for example) via a drive communicating path (not shown) having a gear train and the like.

The reduction sector gear 52 is a two-stage gear integrally formed of a large diameter gear 52A and a small diameter gear 52B. The large diameter gear 52A can engage with the drive gear 51. A notched area 52*a* is formed on the large diameter gear 52A. When the notched area 52*a* is positioned across from the drive gear 51, the drive gear 51 rotates idly.

A feeding drive gear 53 is provided on the outer surface of the frame 63R and is capable of engaging with the small diameter gear 52B of the reduction sector gear 52. A notched area 52*b* is formed on the small diameter gear 52B. When the notched area 52*b* is positioned across from the feeding drive gear 53, the feeding drive gear 53 rotates idly.

By fixing the feeding drive gear 53 to the drive shaft 54 (see FIG. 1), which drives the feeding roller 9, the feeding drive gear 53 rotates together with the feeding roller 9. Accordingly, when the driving force of the drive gear 51 is communicated to the feeding drive gear 53 via the reduction sector gear 52, the drive shaft 54 rotates and drives the feeding roller 9. Further, the driving force of the drive shaft 54 is communicated to the pickup roller 10 via a belt (not shown) or another communicating mechanism such as gears. Through this process the separating/feeding section 7 is driven.

Figure 6:
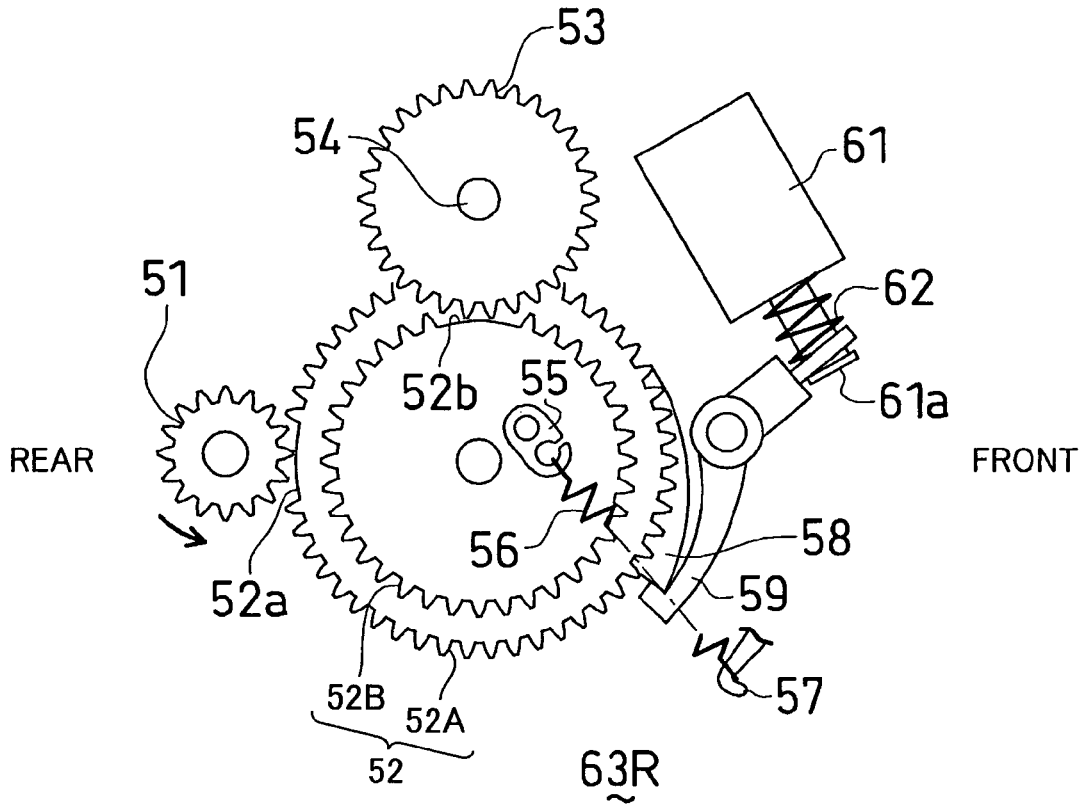
FIG. 6 is a side view showing the construction of a drive unit in a separating/feeding section according to the embodiment of the present invention.

As shown in FIG. 6, one end of a small spring stay 55 is rotatably fixed to a side surface of the reduction sector gear 52. One end of a coil shaped engaging spring 56 is engaged with the other end of the small spring stay 55, while the other end of the engaging spring 56 is engaged with an engaging piece 57 suitably formed on the main casing 2.

A protrusion 58 is integrally formed on the outer surface of the reduction sector gear 52. A stopper arm 59 is supported near the peripheral surface of the reduction sector gear 52 and is capable of pivoting to engage with the protrusion 58. A solenoid 61 is mounted on the frame 63R at an appropriate position. The solenoid 61 has a movable iron core 61*a* that is coupled with the stopper arm 59. A spring 62 is provided around the movable iron core 61*a* for constantly urging the stopper arm 59 coupled with the movable iron core 61*a* in a direction for engaging with the protrusion 58.

With this construction, the reduction sector gear 52 is in the rotational phase shown in FIG. 6 when the separating/feeding section 7 is not feeding the paper 3. In other words, the drive gear 51 opposes the notched area 52*a* of the reduction sector gear 52, and the feeding drive gear 53 opposes the notched area 52*b* of the reduction sector gear 52. Accordingly, the feeding drive gear 53 is not driven, and driving of the separating/feeding section 7 is halted. While the pulling force of the engaging spring 56 urges the reduction sector gear 52 to rotate clockwise, the protrusion 58 of the reduction sector gear 52 is engaged with the stopper arm 59, effectively halting this rotation and keeping the reduction sector gear 52 motionless.

When the solenoid 61 is turned ON at this time, the stopper arm 59 coupled with the movable iron core 61*a* is released from its engagement with the protrusion 58. As a result, the reduction sector gear 52 rotates in the clockwise direction in FIG. 6 by the force of the engaging spring 56. Hence, the drive gear 51 that had opposed the notched area 52*a* now engages with the gear teeth on the reduction sector gear 52, and the rotational force of the drive gear 51 is communicated to the reduction sector gear 52. Similarly, the feeding drive gear 53 that had opposed the notched area 52*b* now engages with the gear teeth of the reduction sector gear 52, and the rotational force of the reduction sector gear 52 is communicated to the feeding drive gear 53. As a result, the rotational force of the drive gear 51 is communicated to the feeding drive gear 53 via the two-stage reduction sector gear 52, which reduces the speed and increases the torque for driving the separating/feeding section 7 (specifically the feeding roller 9 and pickup roller 10) via the drive shaft 54. In this way, the topmost sheet of the paper 3 on top of the paper pressing plate 8 is separated from the other sheets and conveyed by the feeding roller 9. The sheet of paper 3 is received by the first conveying roller 11 immediately downstream and conveyed toward the image-forming section 5.

After the reduction sector gear 52 completes one rotation, returning to the state shown in FIG. 6, the protrusion 58 engages with the stopper arm 59, halting the reduction sector gear 52 with the notched area 52*a* facing the drive gear 51 and the notched area 52*b* facing the feeding drive gear 53. Hence, the rotational force of the drive gear 51 is no longer transferred to the feeding drive gear 53, and driving of the separating/feeding section 7 is halted.

As described above, the separating/feeding section 7 of the laser printer 1 according to the preferred embodiment is configured to separate and feed the paper 3 using the pickup roller 10 and the feeding roller 9. Therefore, the pickup roller 10 and the feeding roller 9 can be made with smaller diameters to reduce the installation space required for the separating/feeding section 7. Since the feeding roller 9 has a smaller diameter, the paper is conveyed a shorter distance per revolution of the feeding roller 9.

However, in the preferred embodiment, the reduction sector gear 52 is disposed upstream of the feeding drive gear 53, which rotates together with the feeding roller 9, with respect to the drive communicating path. The number of teeth in the small diameter gear 52B of the reduction sector gear 52 is greater than the number of teeth in the feeding drive gear 53. Hence, the feeding drive gear 53 can be rotated more than one revolution during the time that the reduction sector gear 52 is rotated once, thereby rotating the small-diameter feeding roller 9 more than one revolution to ensure that the feeding roller 9 conveys the paper 3 a long distance. This means that the paper 3 can be received and conveyed downstream by the first conveying roller 11, even when the distance between the feeding roller 9 and the first conveying roller 11 is large. In other words, this construction prevents driving of the separating/feeding section 7 from halting before the paper 3 conveyed by the feeding roller 9 is interposed between the first conveying roller 11 and the paper dust collecting roller 21.

Further, since the reduction sector gear 52 is a two-stage gear having a small diameter and a large diameter, the reduction sector gear 52 can also function to reduce the speed of the driving force of the drive gear 51 through a simple construction.

When the notched area 52*a* of the reduction sector gear 52 is positioned opposite the drive gear 51, the drive gear 51, which always rotates, rotates idly with respect to the reduction sector gear 52. That is, the rotational force of the drive gear 51 is not communicated to the reduction sector gear 52. As a result, the driving of the separating/feeding section 7 can be initiated at a desired timing (when the solenoid 61 is turned ON in the preferred embodiment).

In addition, while the notched area 52*a* opposes the drive gear 51, the notched area 52*b* faces the feeding drive gear 53, allowing the feeding drive gear 53 to rotate idly with respect to the reduction sector gear 52. As a result, after the paper 3 conveyed by the feeding roller 9 is received by the first conveying roller 11 and the driving of the separating/feeding section 7 is halted, the feeding roller 9 can rotate freely as the paper 3 in contact with the feeding roller 9 is conveyed by the first through third conveying rollers 11-13. Further, the feeding roller 9 can be set to rotate freely when a paper jam occurs, facilitating an operation to remove the jammed paper.

Figure 7:
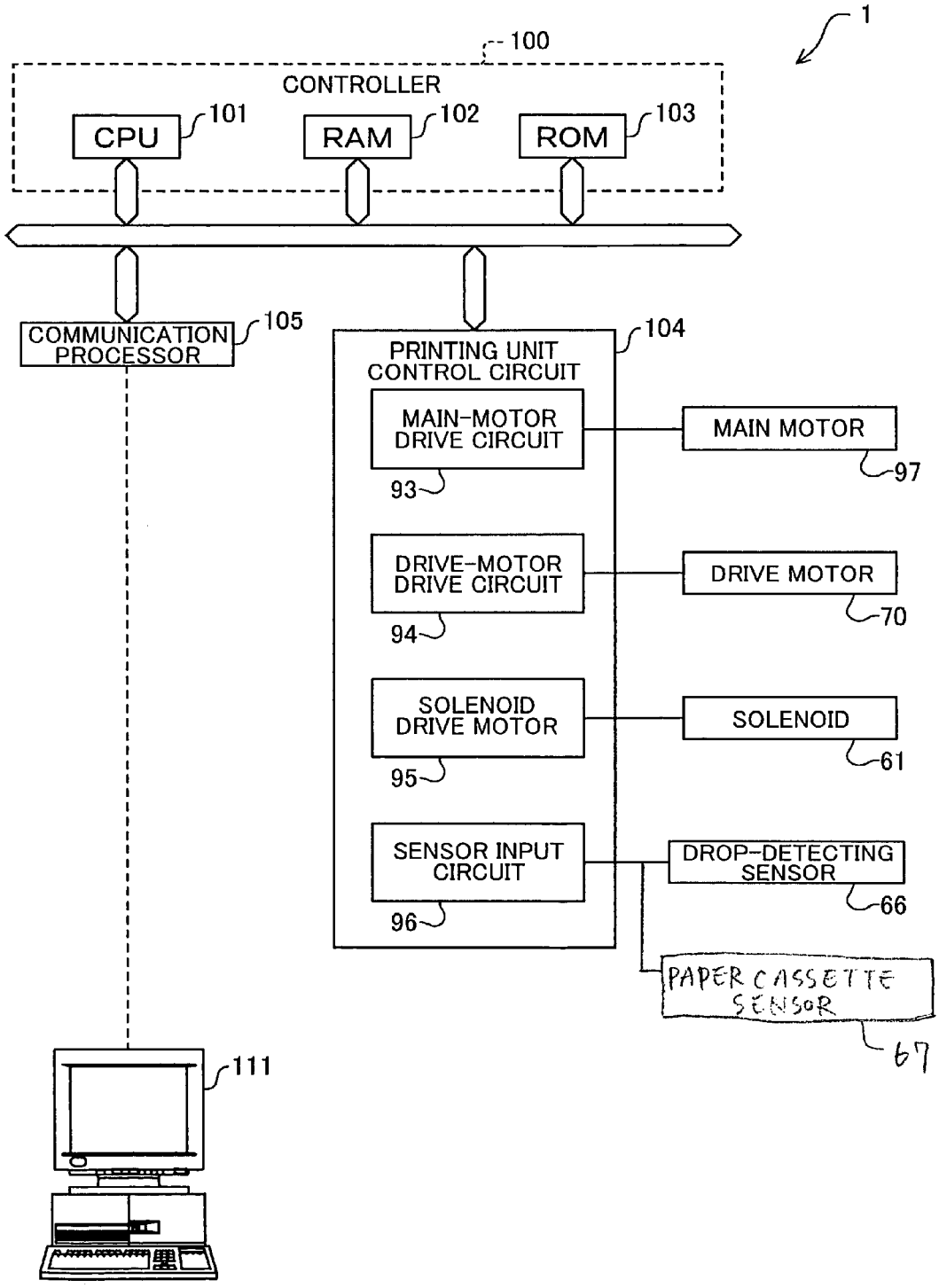
FIG. 7 is a block diagram showing the overall construction of the laser printer.

Next, the controller 100 of the laser printer 1 will be described with reference to FIG. 7. As shown in FIG. 7, the controller 100 of the laser printer 1 includes a CPU 101 for centrally controlling each component of the laser printer 1, a RAM 102 for erasably storing variable data, and a ROM 103 for storing such fixed data as control programs.

The controller 100 is connected to a printing unit control circuit 104 and a communication processor 105 via an appropriate data bus. The printing unit control circuit 104 includes drive circuits 93-95 for driving the separating/feeding section 7, the image-forming section 5, and the like. The communication processor 105 is connected to a host device (a personal computer 111 in the preferred embodiment) via an appropriate cable.

A main motor 97 in the main motor unit 75 drives the rollers and the like in the separating/feeding section 7 and image-forming section 5 and along the paper conveying path. As described above, the drive motor 70 in the pressing plate drive unit 68 drives the paper pressing plate 8. The separating/feeding section 7 is driven when the solenoid 61 is turned ON.

The printing unit control circuit 104 is controlled by the CPU 101 and has functions for driving each member of the printing unit. Specifically, the CPU 101 outputs prescribed signals to the printing unit control circuit 104 based on control programs stored in the ROM 103. Upon receiving these signals, the printing unit control circuit 104 applies a drive current and the like to the main motor 97, the drive motor 70, and the solenoid 61 via the drive circuits 93-95.

The printing unit control circuit 104 is also provided with a sensor input circuit 96. The sensor input circuit 96 is electrically connected to the drop-detecting sensor 66 and the like.

Figure 8:
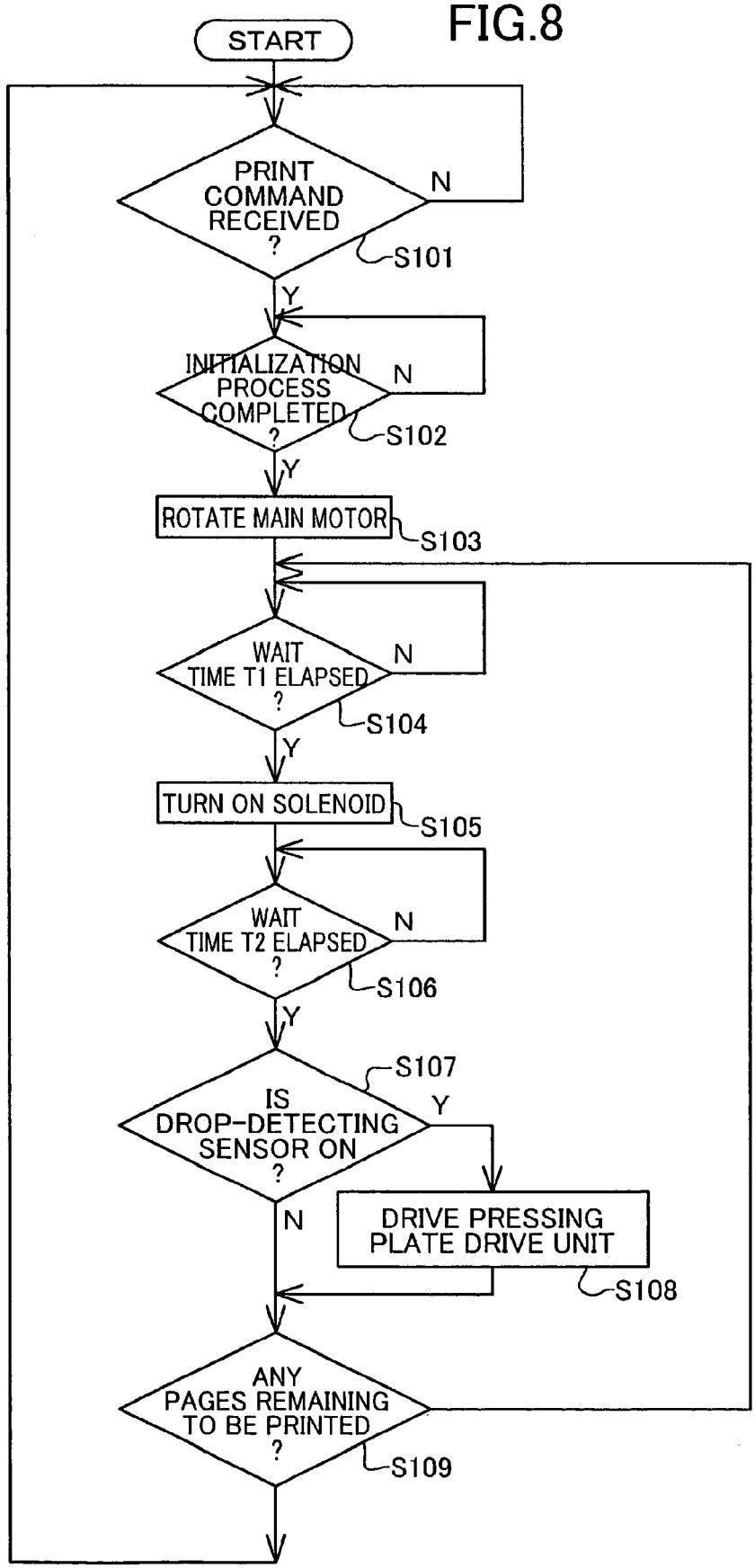
FIG. 8 is a flowchart representing a process for controlling the separating/feeding section and the pressing plate drive unit.

Next, the timing at which driving of the pressing plate drive unit 68 is controlled will be described with reference to FIG. 8. In S101, the controller 100 waits for a print command to be inputted from the personal computer 111. When a print command has been inputted (S101:YES), in S102 the controller 100 waits until a prescribed initialization process has been completed. In this initialization process, the heat roller 31 in the fixing unit 26 is heated to a prescribed temperature suitable for fixing toner.

After the initialization process has been completed in S102, in S103 the controller 100 begins rotating the main motor 97 to drive the drive gear 51 (FIG. 6). In S104, a loop is performed until a prescribed wait time T1 has elapsed for allowing the preparation of a sheet of paper to be fed. Subsequently, the solenoid 61 is turned ON in S105. As a result, the reduction sector gear 52 begins rotating from the state shown in FIG. 6, and the rotations of the drive gear 51 are communicated to the feeding drive gear 53, driving the separating/feeding section 7. The pickup roller 10 in the separating/feeding section 7 picks up one sheet of the paper 3 from the paper pressing plate 8, and the feeding roller 9 and the separating pad 9*a* separate and feed the paper 3 downstream.

While the paper 3 is being picked up and separated by the separating/feeding section 7, the controller 100 performs a loop in S106 until a prescribed time T2 has elapsed after the solenoid 61 was turned ON. When the time T2 has elapsed, the controller 100 determines in S107 whether the status of the drop-detecting sensor 66 described above is ON. When the drop-detecting sensor 66 is ON (S107:YES), this means that the drop-detecting sensor 66 has detected that the pickup roller 10 has dropped below the prescribed height, then in S108 the controller 100 transmits a signal to the pressing plate drive unit 68 to drive the drive motor 70, thereby raising the paper pressing plate 8 a prescribed distance.

In S109, the controller 100 determines whether there are any pages remaining to be printed. If there are still pages to be printed (S109:YES), then the controller 100 returns to S104 to separate and feed the next sheet of paper 3 to be printed. When there are no pages left to be printed (S109:NO), the controller 100 continues driving the main motor 97 until the final sheet of paper has been discharged from the discharge outlet 40 and subsequently halts the main motor 97. At this time, the current printing process is complete. The controller 100 returns to S101 and waits for another print command to be inputted.

In this embodiment, the time T2 in S106 is set greater than the amount of time required for the reduction sector gear 52 to complete one revolution. As a result, the controller 100 begins driving the pressing plate drive unit 68 in the process of S108 when the reduction sector gear 52 has completed one revolution after the solenoid 61 was turned ON in S105.

Directly after the reduction sector gear 52 has completed one revolution, the paper 3 is interposed between the first conveying roller 11 and the paper dust collecting roller 21 and is still in contact with the feeding roller 9. As described above, when the reduction sector gear 52 in the state shown in FIG. 6 rotates once and returns to that state, the drive gear 51 is opposite the notched area 52*a* of the reduction sector gear 52 and rotates idly with respect to the reduction sector gear 52.

As a result, the separating/feeding section 7 is no longer driven.

That is, the controller 100 controls the pressing plate drive unit 68 to begin driving the paper pressing plate 8 when the separating/feeding section 7 is in contact with the paper 3 and driving of the separating/feeding section 7 is halted. Accordingly, sufficient time for driving the paper pressing plate 8 can be ensured, even when the paper 3 is fed at a high speed with a short interval between sequentially fed sheets of paper 3 to achieve high speed printing. Therefore, the laser printer 1 of the present invention can avoid pickup problems caused when the paper pressing plate 8 is not pushed against the pickup roller 10 with sufficient pressure.

By driving the paper pressing plate 8, the amount of pressure with which the paper 3 contacts the pickup roller 10 is varied slightly. However, in the preferred embodiment, the pressing plate drive unit 68 begins driving the paper pressing plate 8 after the topmost sheet is separated from the rest of the paper 3 and driving of the separating/feeding section 7 is halted. Therefore, driving the paper pressing plate 8 does not adversely affect the operation performed by the separating/feeding section 7 to separate the topmost sheet of the paper 3, thereby avoiding problems in separating the topmost sheet of the paper 3 and enabling stable feeding of the paper 3.

The pressing plate drive unit 68 begins driving the paper pressing plate 8 after the topmost sheet of the paper 3 has been separated and the paper 3 has been received by the first conveying roller 11. Since driving of the paper pressing plate 8 does not adversely affect the operation performed by the separating/feeding section 7 to separate the topmost sheet of the paper 3 at this time, the paper 3 can be separated without problem.

By positioning the first conveying roller 11 to oppose the paper dust collecting roller 21 provided in the paper cassette 6, the first conveying roller 11 can be disposed immediately downstream of the separating/feeding section 7, thereby reducing the time required to transfer the paper 3 picked up in the separating/feeding section 7 to the first conveying roller 11 (more specifically, the time until driving of the separating/feeding section 7 is subsequently halted). As a result, sufficient time can be allocated for driving the paper pressing plate 8 with the pressing plate drive unit 68.

However, when printing two or more sheets of paper consecutively, the controller 100 can be configured to wait for the next sheet of paper 3 before driving the pressing plate drive unit 68 rather than immediately driving the pressing plate drive unit 68, even when the drop-detecting sensor 66 detects that the pickup roller 10 has dropped below the prescribed height. More specifically, the controller 100 can control the pressing plate drive unit 68 to drive the paper pressing plate 8 after the sheet of paper 3 contacting the separating/feeding section 7 when the drop-detecting sensor 66 made the detection has passed to the downstream side of the separating/feeding section 7 and when the next sheet of paper 3 contacts the separating/feeding section 7 and the driving of the separating/feeding section 7 has been halted. Alternatively, the controller 100 can control the pressing plate drive unit 68 to drive the paper pressing plate 8 when the next sheet of the paper 3 contacts both the separating/feeding section 7 and the first conveying roller 11.

When performing the control operations described above, the paper pressing plate 8 is not driven until the next sheet of the paper 3 has been separated, even when the drop-detecting sensor 66 detects a decrease in the amount of paper 3 stacked on the paper pressing plate 8. Accordingly, more time can be secured for driving the paper pressing plate 8. Since one sheet of the paper 3 is generally quite thin, the amount of pressure with which the paper 3 contacts the pickup roller 10 does not decline greatly even if the paper pressing plate 8 is not driven immediately. Hence, not driving the paper pressing plate 8 immediately has little effect on the ability to pick up the next sheet of the paper 3, enabling stable feeding of the paper 3.

In the preferred embodiment, the controller 100 controls the pressing plate drive unit 68 in S108 to complete raising of the paper pressing plate 8 before the trailing edge of the paper 3 being conveyed passes the separating/feeding section 7 (more specifically, before the trailing edge of the paper 3 passes between the feeding roller 9 and the separating pad 9*a*).

As a result, raising of the paper pressing plate 8 can be completed with time to spare before the separating/feeding section 7 begins separating the next sheet of the paper 3, thereby ensuring that problems in separation are avoided when the separating/feeding section 7 feeds the next sheet of the paper 3.

In the preferred embodiment, the controller 100 controls the pressing plate drive unit 68 to begin raising the paper pressing plate 8 when a prescribed time T2 has elapsed after the solenoid 61 is turned ON and the separating/feeding section 7 is initially driven.

As a result, a precise timing can be set for beginning to drive the paper pressing plate 8, thereby reliably avoiding adverse effects on the operation performed by the separating/feeding section 7 to separate the paper 3 and allowing the paper 3 to be pressed against the pickup roller 10 and properly picked up by the separating/feeding section 7. Further, since the control process is only a simple operation for measuring time, the controller 100 has a simple configuration in both hardware and software.

While some exemplary embodiments of this invention have been described in detail, those skilled in the art will recognize that there are many possible modifications and variations which may be made in these exemplary embodiments while yet retaining many of the novel features and advantages of the invention.

For example, as shown in FIG. 7, a paper cassette sensor 67 for detecting whether the paper cassette 6 is mounted in the main casing 2 (whether the paper cassette 6 is pulled in and closed) also may be provided on the main casing 2. With this construction, the controller 100 may control the pressing plate drive unit 68 to drive the paper pressing plate 8 when a signal from the paper cassette sensor 67 has been detected.

This construction can improve operability since the paper pressing plate 8 is driven when the paper cassette sensor 67 detects that the paper cassette 6 is mounted in the main casing 2. The construction can conserve energy (specifically, power consumption by the drive motor 70) since the paper pressing plate 8 is not driven when the paper cassette 6 is not mounted in the main casing 2.

In the embodiment described above, the paper pressing plate 8 is raised only a prescribed distance in S108 when the drop-detecting sensor 66 detects a decline in the amount of paper stacked on the paper pressing plate 8 (S107). However, the present invention is not limited to this construction. For example, the paper pressing plate 8 may be continuously raised until the drop-detecting sensor 66 changes from an ON state to an OFF state.

In other words, the controller 100 may control the pressing plate drive unit 68 to drive the paper pressing plate 8 upward until the paper 3 stacked on the paper pressing plate 8 contacts the separating/feeding section 7 with a prescribed pressure.

This construction ensures that the paper 3 contacts the separating/feeding section 7 with an appropriate pressure, facilitating the separating/feeding section 7 in separating and feeding the paper 3 smoothly.

In the embodiment described above, the controller 100 determines whether the drop-detecting sensor 66 is ON or OFF at the prescribed time T2 after the solenoid 61 was turned ON. However, this determination may be performed at any time after the solenoid 61 is turned ON. However, it is desirable that the pressing plate drive unit 68 (paper pressing plate 8) be driven when the prescribed time T2 has elapsed after the solenoid 61 was turned ON.

In the embodiment described above, the controller 100 controls the pressing plate drive unit 68 to begin driving the paper pressing plate 8 when the prescribed time T2 elapses after the solenoid 61 was turned ON. However, the present invention is not limited to this configuration. For example, a paper sensor such as an optical sensor may be provided downstream of the first conveying roller 11 and the controller 100 may perform a control process to begin driving the paper pressing plate 8 when this paper sensor detects the leading edge of the paper 3. Here, the position of the paper sensor and the configuration of the reduction sector gear 52 and the feeding drive gear 53 are set to ensure that the driving of the separating/feeding section 7 has already stopped when the leading edge of the paper 3 trips the paper sensor.

If no print commands (print jobs) have been inputted into the laser printer 1 for an interval that exceeds a prescribed time, the controller 100 may enter a sleep mode and control the pressing plate drive unit 68 to lower the paper pressing plate 8 to its lowest point. This prevents the paper 3 on the paper pressing plate 8 from applying a load between the output gear 73 and the input gear 74 when the laser printer 1 is inactive for a long period of time, thereby keeping the output gear 73 and the input gear 74 free of fatigue and fractures and extending the life of the same.

Further, a temperature sensor may be provided in the fixing unit 26 for detecting the temperature of the heat roller 31, and the controller 100 may control the pressing plate drive unit 68 to lower the paper pressing plate 8 to its lowest point when the temperature detected by the temperature sensor drops below a prescribed temperature. This prevents the paper 3 on the paper pressing plate 8 from applying a load between the output gear 73 and the input gear 74 when the laser printer 1 is inactive for a long period of time, thereby keeping the output gear 73 and the input gear 74 free of fatigue and fractures and extending the life of the same.

The sensor for detecting a decline in the amount of stacked paper 3 (i.e., for detecting the position of the topmost sheet of the paper 3) is not limited to a configuration like the drop-detecting sensor 66 for detecting the height of the pickup roller 10. For example, an optical sensor or the like may be used to directly measure the height of the topmost sheet of the paper 3.

While the separating/feeding section 7 may suffer slightly in compactness, the method of controlling the paper pressing plate 8 may also be applied to an image-forming device provided with a separating/feeding section for both picking up and separating the paper with a single roller.

What is claimed is:

1. An image-forming device comprising:

an image forming unit that forms images on a recording medium;

a plate that mounts a stack of recording medium;

a separating/feeding unit that separates a recording medium from the stack and feeds the recording medium in a conveying direction;

a drive unit that moves the plate toward the separating/feeding unit; and a controller that controls the drive unit to start moving the plate toward the separating/feeding unit when:

the separating/feeding unit is in contact with the stack of recording medium; and driving of the separating/feeding unit has stopped.

2. The image-forming device according to claim 1, further comprising:

a main casing;

a cassette supported in the main casing so as to be slid open and closed, wherein the plate is disposed inside the cassette;

a conveying roller that receives and conveys the recording medium fed from the separating/feeding unit;

an opposing roller disposed in the cassette in confrontation with the conveying roller.

3. The image-forming device according to claim 1, further comprising a sensor that detects a decline in the amount of stacked recording medium, wherein the controller controls the drive unit to start moving the plate when:

the sensor detects a decline in the amount of stacked recording medium;

a recording medium following a recording medium that was in contact with the separating/feeding unit when the decline was detected is in contact with the separating/feeding unit; and driving of the separating/feeding unit has been halted.

4. The image-forming device according to claim 1, further comprising a sensor that detects the position of a topmost recording medium of the stack, wherein the controller controls the drive unit to start moving the plate when:

the sensor detects that the position of the topmost recording medium of the stack has reached a predetermined position;

a recording medium following a recording medium that was in contact with the separating/feeding unit when the decline was detected is in contact with the separating/feeding unit; and driving of the separating/feeding unit has been halted.

5. The image-forming device according to claim 1, wherein the controller controls the drive unit to stop moving the plate before a trailing edge of the recording medium passes the separating/feeding unit.

6. The image-forming device according to claim 1, further comprising a solenoid that starts driving of the separating/feeding unit, wherein the controller controls the drive unit to start moving the plate when a prescribed time has elapsed after the solenoid started driving of the separating/feeding unit.

7. The image-forming device according to claim 1, further comprising:

a main casing;

a cassette supported in the main casing so as to be slid open and closed, wherein the plate is disposed inside the cassette; and a sensor that detects whether the cassette is mounted in the main casing, wherein the controller controls the drive unit only when the cassette is detected to be mounted in the main casing by the sensor.

8. The image-forming device according to claim 7, wherein the separating/feeding unit includes a pickup roller that contacts the stack of recording medium and picks up the recording medium from the stack, a feeding roller positioned downstream of the pickup roller with respect to the conveying direction, and a separating pad disposed in the cassette in confrontation with the feeding roller.

9. The image-forming device according to claim 8, wherein a drive mechanism of the separating/feeding unit includes a gear that rotates integrally with the feeding roller and a two-stage sector gear positioned upstream of the gear with respect to a drive communication path.

10. The image-forming device according to claim 1, wherein the controller controls the drive unit to move the plate until the recording medium stacked on the plate contacts the separating/feeding unit with a prescribed amount of pressure.

11. An image-forming device comprising:

an image forming unit that forms images on a recording medium;

a plate that mounts a stack of recording medium;

a separating/feeding unit that separates a recording medium from the stack and feeds the recording medium in a conveying direction;

a drive unit that moves the plate toward the separating/feeding unit;

a conveying roller disposed downstream of the separating/feeding unit with respect to the conveying direction; and a controller that controls the drive unit to move the plate toward the separating/feeding unit, wherein the controller controls the drive unit to start moving the plate when both the separating/feeding unit and the conveying roller are in contact with the same recording medium, wherein the controller controls the drive unit to stop moving the plate before a trailing edge of the recording medium passes the separating/feeding unit.

12. The image-forming device according to claim 11, further comprising a main casing, a cassette supported in the main casing so as to be slid open and closed, and an opposing roller disposed in the cassette in confrontation with the conveying roller, wherein the plate is disposed inside the cassette.

13. The image-forming device according to claim 11, further comprising a sensor that detects a decline in the amount of stacked recording medium, wherein the controller controls the drive unit to start moving the plate when:

the sensor detects a decline in the amount of stacked recording medium; and a recording medium following a recording medium that was in contact with the separating/feeding unit when the decline was detected is in contact with both the separating/feeding unit and the conveying roller.

14. The image-forming device according to claim 11, further comprising a sensor that detects the position of a topmost recording medium of the stack, wherein the controller controls the drive unit to start moving the plate when:

the sensor detects that the position of the topmost recording medium of the stack has reached a predetermined position;

a recording medium following a recording medium that was in contact with the separating/feeding unit when the decline was detected is in contact with the separating/feeding unit; and driving of the separating/feeding unit has been halted.

15. The image-forming device according to claim 11, further comprising a solenoid that starts driving of the separating/feeding unit, wherein the controller controls the drive unit to start moving the plate when a prescribed time has elapsed after the solenoid started driving of the separating/feeding unit.

16. The image-forming device according to claim 11, further comprising:

a main casing;

a cassette supported in the main casing so as to be slid open and closed, wherein the plate is disposed inside the cassette; and a sensor that detects whether the cassette is mounted in the main casing, wherein the controller controls the drive unit only when the cassette is detected to be mounted in the main casing by the sensor.

17. The image-forming device according to claim 16, wherein the separating/feeding unit includes a pickup roller that contacts the stack of recording medium and picks up the recording medium from the stack, a feeding roller positioned downstream of the pickup roller with respect to the conveying direction, and a separating pad disposed in the cassette in confrontation with the feeding roller.

18. The image-forming device according to claim 17, wherein a drive mechanism of the separating/feeding unit includes a gear that rotates integrally with the feeding roller and a two-stage sector gear positioned upstream of the gear with respect to a drive communication path.

19. The image-forming device according to claim 11, wherein the controller controls the drive unit to move the plate until the recording medium stacked on the plate contacts the separating/feeding unit with a prescribed amount of pressure.

20. An image-forming device comprising:

an image forming unit that forms images on a recording medium;

a plate that mounts a stack of recording medium;

a separating/feeding unit that separates a recording medium from the stack and feeds the recording medium in a conveying direction;

a drive unit that moves the plate toward the separating/feeding unit;

a conveying roller disposed downstream of the separating/feeding unit with respect to the conveying direction;

a controller that controls the drive unit to move the plate toward the separating/feeding unit, wherein the controller controls the drive unit to start moving the plate when:

both the separating/feeding unit and the conveying roller are in contact with the same recording medium;

the separating/feeding unit is in contact with the stack of recording medium; and driving of the separating/feeding unit has stopped.

* * * * *